United States Patent [19]

Daugherty

[11] 4,445,686

[45] May 1, 1984

[54] TENNIS TEACHING DEVICE

[76] Inventor: James C. Daugherty, 2709 Cypress, Muncie, Ind. 47302

[21] Appl. No.: 188,933

[22] Filed: Sep. 19, 1980

[51] Int. Cl.[3] ..... A63B 69/38

[52] U.S. Cl. ..... 273/29 A

[58] Field of Search ..... 273/29 A, 189 A, 73 R, 273/67 R, 73 J, 75, 81 R, 81 D, 162, 188 R, 188 A, 189 R, 189 A, 81.3, 191 B, 183 B, 185 C, 186 R, 190 A, 190 B

[56] References Cited

U.S. PATENT DOCUMENTS

| | | | |
|---|---|---|---|
| 2,189,997 | 2/1940 | Salem | 273/29 A |
| 3,693,973 | 9/1972 | Wattenberg | 273/29 A |
| 3,814,419 | 6/1974 | Bjorklund | 273/29 A |
| 3,858,881 | 1/1975 | Hurwitz | 273/73 R |

FOREIGN PATENT DOCUMENTS

| | | | |
|---|---|---|---|
| 16681 | of 1903 | United Kingdom | 273/75 |
| 205442 | 10/1923 | United Kingdom | 273/75 |

*Primary Examiner*—Richard C. Pinkham
*Assistant Examiner*—T. Brown

[57] ABSTRACT

A tennis teaching device for teaching the proper wrist position during the stroke of a tennis racket. The tennis teaching device comprises an elongated strap which is removably attached at a first end to the throat portion of a tennis racket. An attaching member removably attaches the second end of the strap to the forearm of the player. The second end of the strap is disposed at a predetermined upward extending angle and rotated a predetermined angular amount about the center axis of the strap with respect to the first end so as to be in registry with the forearm and wrist of the player when attached thereto to hold the wrist of the player in a fixed position throughout the entire stroke of the racket.

10 Claims, 4 Drawing Figures

TENNIS TEACHING DEVICE

BACKGROUND OF THE DISCLOSURE

1. Field of the Invention

This invention relates, in general, to tennis rackets and, more specifically, to teaching devices for use with tennis rackets.

2. Description of the Prior Art

In playing the game of tennis, one of the most important factors in executing a proper forehand or backhand stroke is the wrist position, that is, the position of the wrist of the player during the stroke of the racket. The reason for the importance of the wrist position is the fact that the wrist position determines at what angle and at what height the face of the racket strikes the ball. A slight variance from a correct wrist position easily results in the ball varying widely from its intended path after it is hit.

It has been established that the wrist must be in one position throughout the entire stroke in order to insure that the racket face is in a completely vertical position when it impacts with the ball and, more importantly, that the wrist remains in this position throughout the contact zone to ensure maximum control of the shot. However, such a fixed wrist position is difficult to consistently achieve without years of instruction and practice. Additionally, without the guidance of a skilled professional or instructor, an incorrect wrist position is difficult to detect as well as to correct.

Although many devices and structures have been devised over the years to aid the tennis player in perfecting the proper hand grip, nothing has been devised to ensure the proper wrist position or to train the player in the proper wrist position.

Thus, it would be desirable to provide a tennis teaching device which teaches the player the proper wrist position during the stroke of the racket. It would also be desirable to provide a tennis teaching device which is usable by any level tennis player, from beginner to expert, to learn and develop the proper wrist position. Finally, it would be desirable to provide a tennis teaching device which teaches the proper wrist position during both forehand and backhand strokes of the racket.

SUMMARY OF THE INVENTION

There is disclosed herein a unique tennis teaching device which teaches the player the proper wrist position during the stroke of a tennis racket. The tennis teaching device comprises an elongated strap having first and second end portions. First attaching means are provided to removably attach the first end of the strap to the throat portion of the tennis racket. Second attaching means are also provided for removably attaching the second end of the strap to the forearm of the player.

The strap includes an integral intermediate portion which is disposed at an upward extending angle with respect to the first end portion and, further, is twisted or rotated about the center axis of the strap. The second end portion is further upwardly inclined from the intermediate portion so as to be disposed in registry with the lower portion of the forearm and the wrist of the player when the tennis teaching device is secured to the forearm of the player and the player grips the racket. In this manner, the wrist of the player is held in a fixed position throughout the entire stroke of the racket.

In order to hold the wrist of the player in a fixed position throughout a backhand stroke, the tennis teaching device is constructed in another embodiment with the intermediate portion being disposed at a predetermined upwardly extending angle from the first end portion and the second end portion is disposed at a further upward extending angle and is rotated a predetermined angular amount about the center axis of the strap with respect to the intermediate portion.

The tennis teaching device disclosed herein uniquely teaches a tennis player the correct wrist position during the stroke of a tennis racket by holding the wrist in a fixed position throughout the entire stroke. The tennis teaching device is suitable for use by any level tennis player. It is ideally suited for beginners to enable them to learn and develop the proper wrist position. Furthermore, it is also usable by the intermediate level player who needs to develop consistently in applying the proper wrist position, as well as the advanced player who wants to develop the proper forearm leverage behind the ball. Further, the tennis teaching device is usable in both forehand and backhand strokes and is simple in both design and construction.

BRIEF DESCRIPTION OF THE DRAWING

The various features, advantages and other uses of this invention will become more apparent by referring to the following detailed description and drawing in which.

DESCRIPTION OF THE PREFERRED EMBODIMENT

Figure 3:
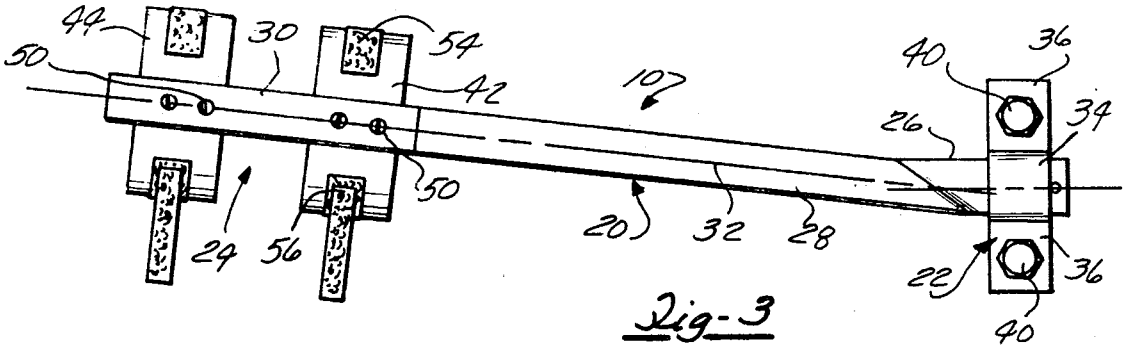
FIG. 3 is a plan view of the tennis teaching device illustrated in FIG. 2.

Throughout the following description and drawing, identical reference numbers are used to refer to the same component shown in multiple figures of the drawing.

Figure 1:
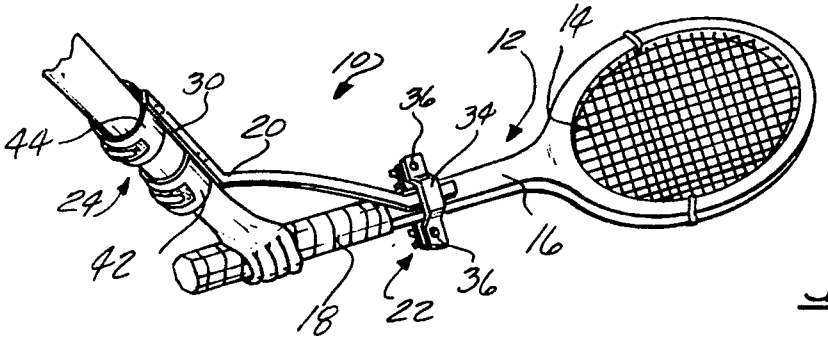
FIG. 1 is a perspective view of one embodiment of a tennis teaching device of the present invention attached to a tennis racket and the forearm of a tennis player and constructed for use with forehand strokes.

Referring now to the drawing, and to FIG. 1 in particular, there is illustrated one embodiment of a tennis teaching device 10 which teaches a tennis player the proper wrist position during the forehand stroke of a tennis racket. The tennis teaching device 10 is suitable for use with any conventionally formed tennis racket 12. The tennis racket 12 is conventionally formed with a head portion 14 which consists of a frame surrounding a plurality of interwoven strings. Extending from the head portion 14 is a throat portion 16 of substantially rectangular cross section. A band grip 18 is formed on the lower portion of the tennis racket 12 and generally includes approximately eight flat surfaces around its periphery.

Figure 2:
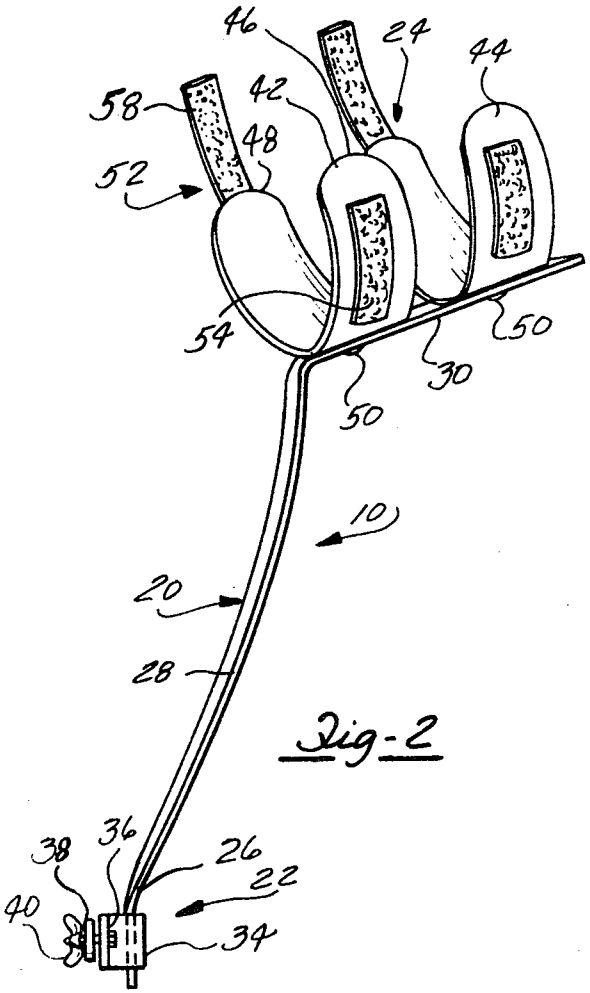
FIG. 2 is an elevational view of the tennis teaching device shown in FIG. 1.

As shown in FIG. 1, and in greater detail in FIGS. 2 and 3, the tennis teaching device 10 comprises an elongated strap 20, first attaching means 22 for attaching one end of the strap 20 to the throat portion 16 of the tennis racket 12 and the second attaching means 24 for attaching the opposite end of the strap 20 to the forearm of the player.

The strap 20 comprises an elongated thin strip of substantially rectangular cross-sectional configuration. The strap 20 is formed of a suitable material, such as a metallic material, to provide rigidity to the tennis teaching device 10.

The strap 20 includes a first end portion 26, an intermediate portion 28 and a second end portion 30, all of which are integrally formed. As shown in FIG. 2, the first end portion 26 is substantially flat so as to be in registry with the upper surface of the throat portion 16 of the tennis racket 12 when applied thereto.

The intermediate portion 28 extends upward from the first end portion 26 at a predetermined angle such that the top surface of the first end portion 26 and the intermediate portion 28 are disposed approximately 120° apart. In addition, the intermediate portion 28 of the strap 20 is twisted or rotated a predetermined angular amount, from about 10° to 45°, about the longitudinal center axis 32 of the strap 20 and is slightly arched in a convex manner. The intermediate portion 28 is thus skewed or angularly offset from the first end portion 26 in both the horizontal and vertical directions. Finally, the second end portion 30 extends upward from the intermediate portion 28 at a predetermined angle, approximately 120°, so as to be disposed in registry with the lower forearm and wrist of the player, as shown in FIG. 1, when the tennis teaching device 10 is connected to the tennis racket 12 and the forearm of the player.

The first end 26 of the strap 20 is attached to the throat portion 16 of the tennis racket 12 preferably immediately adjacent to the end of the hand grip 18 by the attaching means 22. Any suitable arrangement for removably attaching the first end 26 of the strap 20 to the throat portion 16 of the tennis racket 12 may be utilized. By way of illustration, and not limitation, the attaching means 22 is illustrated as comprising a clamp 34. The clamp 34 is in the form of a substantially U-shaped member having outward extending side flanges 36. Apertures, not shown, are formed in the flanges 36 to receive conventional fasteners, as described hereafter. The member is adapted to be disposed over the upper surface of the throat 16 of the tennis racket 12 and to sandwich the first end 26 of the strap 20 therebetween.

The first attaching means 22 further includes a substantially flat plate 38 which is adapted to be disposed adjacent the bottom surface of the throat 16 of the tennis racket 12. The plate 38 has a pair of apertures formed therein which are aligned with the apertures in the U-shaped member. Any conventional fastening means may be utilized to connect the clamp 34 and the plate 38 together. Preferably, wing nuts 40 are utilized to provide an easy and quick arrangement for attaching the tennis teaching device 10 to the tennis racket 12.

Figure 4:
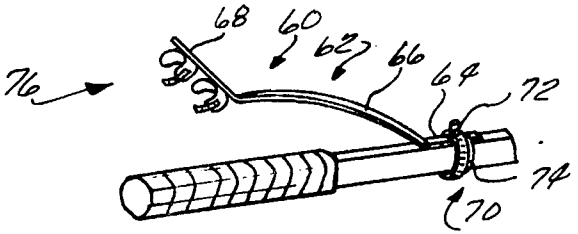
FIG. 4 is a partial perspective view of another embodiment of the tennis teaching device of the present invention constructed for use with backhand strokes.

Other alternate clamping means, such as an adjustable circumference reducing ring 72, as shown in FIG. 4 can also be employed to attach the first end 26 of the strap 20 to the tennis racket. In order to prevent damage to the racket, a cushion or padding 74 is disposed between the clamping means and the throat of the racket Second attaching means 24 are provided for removably attaching the second end 30 of the strap 20 to the forearm of a tennis player. According to the preferred embodiment of this invention, the second attaching means 24 comprises a pair of spaced sleeves 42 and 44 which are joined to the second end 30 of the strap 20.

Although a pair of spaced sleeves are illustrated as forming the second attaching means 24 of this invention, it will be understood that a single sleeve, which may be elongated, may also be used to practice the present invention.

Since the sleeves 42 and 44 are substantially identically constructed, only a detailed description of one of the sleeves, such as sleeve 42, will be described hereafter. The sleeve 42 is in the form of a substantially C-shaped member or band having spaced ends 46 and 48. The central portion of the band is fastened to the bottom side of the strap 20 by any conventional means, such as pop rivets 50. The band is formed of any suitable material having sufficient strength to retain the strap 20 on the forearm of the player. Thus, for example, leather, rigid plastic, reinforced fabric or a metallic material can be used. In any event, the selected material provides a degree of flexibility to enable the spaced ends 46 and 48 to flex and separate so as to enable the forearm of the player to be inserted and removed from the sleeve 42.

Fastening means, denoted generally by reference number 52, are mounted on the band 42 so as to securely retain the forearm of the player within the band 42. Although any suitable type of fastening means may be utilized, preferably, Velcro strips 54 and 56 of looped nylon are secured to the depending sides of the band 42. A corresponding Velcro strap 58 is provided to span and join the Velcro strips 54 and 56 and thereby securely attach the tennis teaching device 10 to the forearm of the player.

In use, the first end of the tennis teaching device 10 is attached to the throat portion 16 of the tennis racket 12. Ideally, the first end 26 of the strap 20 is located immediately adjacent to the end of the hand grip 18 as most tennis rackets being constructed today are basically the same at this point. However, the actual point of connection of the tennis teaching device on the throat 16 of the racket 12 can be moved up or down the throat to accommodate various arm lengths of the user. The player then grasps the hand grip 18 of the racket 12 in a conventional forehand grip. Finally, the player inserts his forearm into the sleeves 42 and 44 and fastens the ends of the sleeves 42 and 44 together by means of the straps 58 to securely retain his forearm within the sleeves 42 and 44.

As viewed in FIG. 1, when the tennis teaching device 10 has been attached to the forearm of the player, the second end 30 of the strap 20 is disposed in registry with the lower portion of the forearm and the wrist of the player. Due to the rigidity provided by the strap 20 of the tennis teaching device 10, the wrist of the player is held in a fixed position and is not allowed to bend or flex during the entire stroke of the tennis racket. This ensures that the proper wrist portion is maintained throughout the entire forehand tennis stroke.

Referring now to FIG. 4, there is illustrated a tennis teaching device 60 constructed according to another embodiment of the present invention which fixes the wrist of the player in a fixed position throughout the entire backhand stroke. The tennis teaching device 60 includes an elongated strap 62 which is formed with a substantially flat first end portion 64, an intermediate portion 66 and a second end portion 68.

The intermediate portion 66 of the strap 62 is formed at a predetermined upward extending angle, approximately 120°, with respect to the first end portion 64. Further, the second end portion 68 is disposed at a further predetermined upward extending angle, approximately 120°, and is rotated a predetermined angular amount, approximately 10° to 45°, about the center axis of the strap 62 with respect to the intermediate portion 66. In this manner, the second end portion 68 will be disposed in registry with the lower forearm and wrist of the player when the player grasps the racket and secures the tennis teaching device 60 to his forearm.

First attaching means 70 is provided for attaching the first end portion 64 of the strap 62 to the throat portion of a tennis racket. Preferably, the first attaching means 70 comprises an ajustable, circumference reducing ring 72 which encircles the throat portion of the tennis racket and the first end portion 64 of the strap 62. The ring 72 is tightened by means of a screwdriver which reduces the circumference of the ring and securely attached the strap 62 to the tennis racket. Suitable cushioning or padding 74 is disposed between the throat portion of the tennis racket and the clamp 72 and the first end portion 64 of the strap 62 in order to prevent damage to the tennis racket. It should be noted that the strap 62 of the tennis teaching device 60 is secured to the narrow side face portion of the throat of the tennis racket in order that the player may grip the tennis racket in the standard backhand grip.

Second attaching means 76 are provided for securing the second end portion 68 of the strap 62 to the forearm and wrist of the player. Preferably, the second attaching means 76 is in the form of bands, which are identical to the bands 42 and 44 described above. As such, a detailed description of the second attaching means 76 will not be provided herein.

Although the intermediate portion 66 of the strap 62 may be formed in a linearly extending fashion, it is preferred that the intermediate portion 66 be formed in a convex arcuate configuration between the first and second end portions 64 and 68, respectively. This provides increased space between the bottom surface of the intermediate portion 66 and the tennis racket so as to enable a two-handed backhand grip to be employed if desired.

The tennis teaching device 60 is employed in the same manner as the above described tennis teaching device 10 and, when secured to the forearm of a player, ensures that the wrist is held in a fixed position throughout the entire backhand swing of the tennis racket.

In summary, there has been disclosed a unique tennis teaching device which novelly teaches the proper wrist position during the stroke of a tennis racket. The tennis teaching device of the present invention holds the wrist of the player in a fixed position throughout the entire stroke thereby aiding the player in learning and developing the proper wrist position.

What is claimed is:

1. A tennis teaching device adapted to be removably secured to a tennis racket having a head portion, a throat portion and a hand grip comprising:

a substantially rigid strap having first and second end portions and an intermediate portion disposed between said first and second end portions;

first means for removably attaching said first end porion of said strap to said throat portion of said racket; and second means for removably attaching said second end portion of said strap to the forearm of a player adjacent to the wrist of the player;

said intermediate portion being disposed at a predetermined angle relative to said first end portion along the longitudinal central axis of said strap, said predetermined angle being formed by bending said strap along said longitudinal central axis, said intermediate portion further being rotated a predetermined angular amount relative to said first end portion, said predetermined angular amount being formed by rotating said intermediate portion in a direction substantially perpendicular to said longitudinal central axis of said strap;

said second end portion of said strap being disposed at a predetermined angle relative to said intermediate portion along said longitudinal central axis of said strap, said predetermined angle being formed by bending said strap along said longitudinal central axis at another location along said strap;

said strap and said first and second attaching means cooperating to hold the forearm and the wrist of said player in a fixed position relative to said tennis racket throughout the stroke of said racket.

2. The tennis teaching device of claim 1 wherein the predetermined angles between the intermediate and second end portions are selected such that said second end portion is disposed in registry with the forearm and wrist of the player when said tennis teaching device is attached thereto and the player grips the hand grip of the tennis racket.

3. The tennis teaching device of claim 1 wherein the predetermined angle between the first end portion and the intermediate portion is approximately 120° and the predetermined amount of angular rotation of said intermediate portion relative to said first end portion is from about 10° to about 45°.

4. The tennis teaching device of claim 1 wherein the second attaching means comprises:

a substantially C-shaped band having spaced ends, said band being secured to the strap and adapted to receive the forearm of the player; and fastening means carried by said band for removably securing said band around said forearm of said player.

5. The tennis teaching device of claim 4 wherein the second attaching means includes a pair of bands spaced along the second end portion of the strap.

6. The tennis teaching device of claim 4 wherein the fastening means comprises velcro strips attached to the sides of the C-shaped band and a corresponding Velcro strap adapted to connect said velcro strips.

7. The tennis teaching device of claim 1 wherein the first attaching means comprises:

a first, substantially U-shaped member having outward extending flanges, said first member adapted to be disposed along one side of the throat of a tennis racket and sandwich the first end portion of the strap therebetween;

a second substantially flat member adapted to be disposed in registry with the opposite side of said throat portion of said racket; and means for fastening said first and second members in secure engagement around said throat portion of said racket.

8. The tennis teaching device of claim 1 wherein:

the end portion, further, is rotated a predetermined angular amount relative to the intermediate portion, said predetermined angular amount being formed by rotating said second end portion in a direction substantially perpendicular to the longitudinal central axis of said strap.

9. The tennis teaching device of claim 8 wherein the intermediate portion is formed in a convex arcuate configuration between the first and second end portions.

10. The tennis teaching device of claim 1 wherein the intermediate portion is formed in a convex arcuate configuration between the first and second end portions.

* * * * *